US011478907B2

(12) United States Patent
Wang

(10) Patent No.: US 11,478,907 B2
(45) Date of Patent: Oct. 25, 2022

(54) SCREWDRIVER HEAD AND METHOD FOR MANUFACTURING THE SAME

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Weiyi Wang, Hangzhou (CN)

(73) Assignee: HANGZHOU GREAT STAR TOOLS CO., LTD., Hangzhou (CN)

( * ) Notice: Subject to any disclaimer, the term of this patent is extended or adjusted under 35 U.S.C. 154(b) by 448 days.

(21) Appl. No.: 16/465,482

(22) PCT Filed: Nov. 30, 2016

(86) PCT No.: PCT/CN2016/108055
§ 371 (c)(1),
(2) Date: May 30, 2019

(87) PCT Pub. No.: WO2018/098700
PCT Pub. Date: Jun. 7, 2018

(65) Prior Publication Data

US 2019/0291246 A1 Sep. 26, 2019

(51) Int. Cl.
*B25B 15/00* (2006.01)
*B25B 15/02* (2006.01)
(Continued)

(52) U.S. Cl.
CPC ..... *B25B 15/002* (2013.01); *B25B 15/02* (2013.01); *B25B 23/0035* (2013.01);
(Continued)

(58) Field of Classification Search
CPC ..... B25B 15/001; B25B 15/002; B25B 15/02; B25B 3/0035; B25B 23/16; B25B 15/007;
(Continued)

(56) References Cited

U.S. PATENT DOCUMENTS 5,704,261 A 1/1998 Strauch et al.
5,868,047 A * 2/1999 Faust ..... B25B 15/00 81/438
(Continued)

FOREIGN PATENT DOCUMENTS

CN 203245782 U 10/2013
CN 105714074 A 6/2016

OTHER PUBLICATIONS

English translation of CN 105714074 A, Jun. 2016.*
International Search Report and Written Opinion for Application No. PCT/CN2016/108055 dated Sep. 1, 2017, 15 pages.

*Primary Examiner* — Hwei-Siu C Payer
(74) *Attorney, Agent, or Firm* — Alston & Bird LLP

(57) ABSTRACT

The present invention discloses a method for manufacturing a screwdriver head, the screwdriver head including a head portion for being inserted into a slot of a screw head and a basal body for supporting the head portion; the manufacturing method including: providing the screwdriver head made of a first metal material; preparing alloying coating; coating the alloying coating on the surface of the head portion of the screwdriver head; conducting laser surface alloying treatment on the surface of the head portion coated with the alloying coating to form an alloyed layer; and conducting low temperature tempering treatment on the screwdriver head after the laser surface alloying treatment. The present invention further discloses a screwdriver head, the surface of the position at which the head portion of the screwdriver head contacts with the slot of the screw head is provided with an alloyed layer formed through the laser surface alloying treatment. The screwdriver head manufactured by the manufacturing method of the present invention has high rigidity and high abrasive resistance in the head portion and high tenacity in other portions, thereby prolonging the service life.

17 Claims, 5 Drawing Sheets

(51) Int. Cl.

| | |
|---|---|
| ***B25B 23/00*** | (2006.01) |
| ***B25B 23/16*** | (2006.01) |
| ***C21D 9/00*** | (2006.01) |
| ***C23C 30/00*** | (2006.01) |
| ***C22C 30/00*** | (2006.01) |

(52) U.S. Cl.
CPC ..... *B25B 23/16* (2013.01); *C21D 9/00* (2013.01); *C21D 9/0068* (2013.01); *C22C 30/00* (2013.01); *C23C 30/00* (2013.01); *B25B 15/005* (2013.01); *B25B 15/007* (2013.01); *B25B 15/008* (2013.01)

(58) Field of Classification Search
CPC ..... B25B 15/008; B25B 15/005; C22C 30/00; C23C 30/00; D21D 9/00
See application file for complete search history.

(56) References Cited

U.S. PATENT DOCUMENTS

| | | | | |
|---|---|---|---|---|
| 5,953,969 | A | 9/1999 | Roscnhan | |
| 2003/0196527 | A1* | 10/2003 | Strauch | B25B 15/002 81/436 |
| 2012/0156520 | A1* | 6/2012 | Meyer | B23K 9/042 428/684 |
| 2012/0285301 | A1 | 11/2012 | Totsu | |
| 2019/0291246 | A1* | 9/2019 | Wang | B25B 23/16 |
| 2021/0086332 | A1* | 3/2021 | Kuter-Arnebeck | B25B 23/108 |

* cited by examiner

SCREWDRIVER HEAD AND METHOD FOR MANUFACTURING THE SAME

CROSS-REFERENCE TO RELATED APPLICATIONS

This application is a national phase entry of International Application No. PCT/CN2016/108055, filed Nov. 30, 2016, the entire contents of which are incorporated herein by reference.

FIELD OF THE INVENTION

The present invention relates to a screwdriver head, and in particular, to a screwdriver head with high rigidity and high abrasive resistance in a head portion as well as high tenacity in other portions by forming an alloyed layer on the surface of the head portion of the screwdriver head through laser surface alloying treatment. The present invention further relates to a method for manufacturing the screwdriver head.

DESCRIPTION OF THE PRIOR ART

A screwdriver is a tool for screwing or unscrewing screws. According to its type and configuration, the screwdriver can be categorized into an ordinary integrated screwdriver and a combined screwdriver, in which a handle of the ordinary screwdriver is inseparably integrated with its screwdriver head; a handle of the combined screwdriver can be combined with or separated from its screwdriver head. The screwdriver head is provided with a head portion for being inserted into a slot of a screw head and a basal body for supporting the head portion. Generally, the head portion of the screwdriver head commonly has a slotted shape, a cross shape, a star shape, an intersected shape, a square shape and a hexagonal shape.

Based on the difference in function, the head portion and basal body of the screwdriver head have different structural characteristics. In order to overcome a torque generated when screwing the screw, the basal body of the screwdriver head needs sufficient tenacity and the head portion inserted into the slot of the screw head needs high rigidity and high abrasive resistance. A conventional screwdriver head is made of an integral material, and in other words, the head portion and the basal body of the screwdriver head are made into required forms by a single material, and then a heat-treating process is conducted on the whole, thereby finishing the manufacture of the conventional screwdriver head. For the screwdriver head made of an integral material, the requirements of high rigidity and high abrasive resistance in the head portion of the screwdriver head and of high tenacity in other portions are not usually satisfied at the same time.

Therefore, one of the goals the producers and the developers of the screwdriver head keep on trying for is to realize high rigidity and high abrasive resistance in the head portion and high tenacity in other portions at the same time.

SUMMARY OF THE INVENTION

The technical problem to be solved by the present invention is to provide a screwdriver head with high rigidity and high abrasive resistance in the head portion as well as high tenacity in other portions and with a long service life, as well as a method for manufacturing the screwdriver head.

In order to solve the above technical problem, the present invention provides a method for manufacturing a screwdriver head, comprising:

providing a screwdriver head made of a first metal material, wherein the screwdriver head comprises a head portion for being inserted into a slot of a screw head and a basal body for supporting the head portion;

preparing alloying coating;

coating the alloying coating on the surface of the head portion of the screwdriver head;

conducting laser surface alloying treatment on the surface of the head portion of the screwdriver head coated with the alloying coating, and forming an alloyed layer on the surface of the head portion of the screwdriver head; and conducting low temperature tempering treatment on the screwdriver head after the laser surface alloying treatment.

Further, the first metal material comprises any one of spring steel, alloy structural steel and tool steel.

Further, the alloying coating contains a large quantity of alloy elements such as W, Mo, Ti, V and Al. During the laser surface alloying treatment conducted on the surface of the head portion of the screwdriver head, a laser beam first melts the alloying coating containing the alloy elements such as W, Mo, Ti, V and Al and a surface layer of the head portion of the screwdriver head close to the coating, and the alloying coating and its alloy elements fuse into the surface layer of the head portion of the screwdriver to form an alloyed layer, that is, the alloy elements in the alloyed layer are from the alloying coating.

As a further improvement of the manufacturing method of the present invention, the alloying coating is coated on a surface of a position at which the head portion of the screwdriver head contacts with the slot of the screw head.

Further, by mass percentage, the alloying coating contains 5~20 of C, 2~18 of B, 2~38 of Si, 0.2~6 of N, 0.5~15 of O, 0.3~6 of Al, 2~10 of Mo, 2~10 of V, 2~20 of W and 2~20 of Ti.

Preferably, by mass percentage, the alloying coating contains 5.5~17 of C, 2.7~16.6 of B, 2.3~29.6 of Si, 0.22~4.9 of N, 0.56~13.7 of O, 0.33~5.6 of Al, 2.7~9.8 of Mo, 2.7~9.8 of V, 2.7~19.8 of W and 2.7~19.8 of Ti.

Further, the process parameters for the laser surface alloying treatment comprises: 200~3000 W of laser power, 0.2~3 mm of spot diameter, 5~80 mm/min of laser scanning speed, and 0.05~1 mm of the thickness of the alloying coating.

Preferably, the process parameters for the laser surface alloying treatment comprises: 280~2600 W of laser power, 0.2~2.8 mm of spot diameter, 5.5~75 mm/min of laser scanning speed, and 0.07~1 mm of the thickness of the alloying coating.

Further, a wave length of the laser used in the laser surface alloying treatment is no greater than 10.6 um, and the power of the laser is greater than 2000 W.

Preferably, the wave length of the laser used in the laser surface alloying treatment is no greater than 1.06 um, and the power of the laser is greater than 2000 W.

Further, the low temperature tempering treatment comprises heating the screwdriver head after the laser surface alloying treatment to 160 to 180° C., and conducting heat preservation for 1 hour.

Preferably, the low temperature tempering treatment comprises heating the screwdriver head after the laser surface alloying treatment to 180° C. by using a low temperature tempering furnace with gas cycling, and conducting heat preservation for 1 hour. The low temperature tempering furnace enables the distribution of temperature inside the tempering furnace to be more uniform by means of the gas cycling.

Another aspect of the present invention provides a screwdriver head which is made of a first metal material, the screwdriver head at least comprising: a head portion for being inserted into a slot of a screw head and a basal body for supporting the head portion, and an alloyed layer formed on the surface of the head portion.

The alloyed layer is formed by alloying coating coated on the surface of the head portion at least containing one or more alloy elements of C, B, Si, N, O, Al, Mo, V, W and Ti by conducting laser surface alloying treatment.

The alloyed layer has a cryptocrystalline martensite structure with tiny crystal particle size, and the alloyed layer has nearly no defects of segregation, microcrack, air hole and slag inclusion.

As a preferred structure of the screwdriver head of the present invention, the alloyed layer is formed to the position at which the head portion contacts with the slot of the screw head.

Further, the first metal material comprises any one of spring steel, alloy structural steel and tool steel.

Further, the depth of the alloyed layer is no less than 0.05 mm.

Further, compared with the rigidity of the basal body, the rigidity of the alloyed layer is increased by greater than 2 HRC.

Further, a heat affected zone is provided between the alloyed layer and the basal body, and the width of the heat affected zone is no greater than 1.0 mm.

Further, compared with the rigidity of the basal body, the rigidity of the heat affected zone is decreased, with a decreased magnitude no greater than 8 HRC.

Another aspect of the present invention provides a screwdriver which comprises the screwdriver head made by the above method for manufacturing the screwdriver head, or the above screwdriver head and a handle which is used for connecting the screwdriver head.

Further, the handle of the above screwdriver is inseparably integrated with the screwdriver head.

Further, the handle of the above screwdriver is provided with a combined hole, into or from which the basal body of the screwdriver head can be inserted or withdrawn.

Further, the head portion, for being inserted into the slot of the screw head, of the above screwdriver head has any one of a slotted shape, a cross shape, a star shape, an intersected shape, a square shape and a hexagonal shape.

In the method for manufacturing a screwdriver head proposed by the present invention and the screwdriver head made by the manufacturing method, the alloyed layer is formed at the head portion of the screwdriver head by a surface modification process of the laser surface alloying treatment, which makes the head portion have high rigidity and high abrasive resistance and other positions have high tenacity, thereby enabling the screwdriver head made by the method for manufacturing a screwdriver head proposed by the present invention to have a longer service life.

The alloyed layer of the screwdriver head proposed by the present invention is formed by alloying coating coated on the surface of the head portion at least containing one or more alloy elements of C, B, Si, N, O, Al, Mo, V, W and Ti by conducting laser surface alloying treatment. The alloyed layer has a cryptocrystalline martensite structure with tiny crystal particle size, which further improves the abrasive resistance of the head portion. Compared with the conventional screwdriver head which is not produced by the method for manufacturing a screwdriver head proposed by the present invention, the front and side of the head portion of the screwdriver head produced by the method for manufacturing a screwdriver head proposed by the present invention are not abraded noticeably after this screwdriver head is in practice used to manually screw 500 tapping screws with a size of 3.5*50 mm on a pine board, which obviously prolongs the service life of the screwdriver head.

The technical conception and specific embodiments of the present invention will be further illustrated in detail below in conjunction with the accompanying drawings.

REFERENCE NUMERAL

Figure 1A:
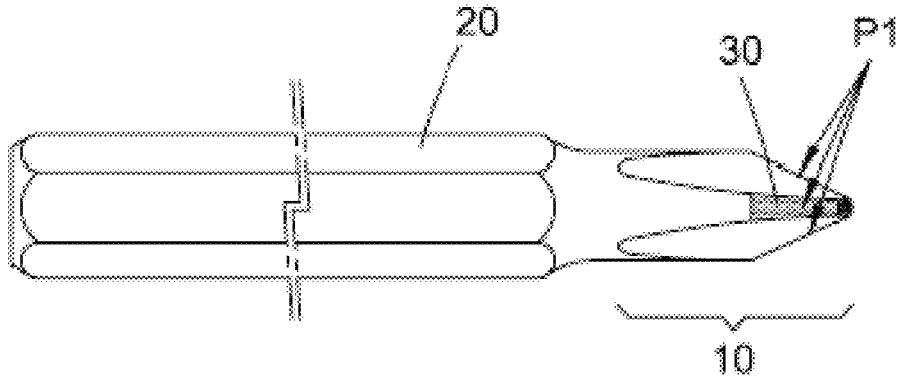
FIG. 1A is a structural diagram of one embodiment of the screwdriver head of the present invention, showing the configuration of the screwdriver head with a cross-shaped head portion and the position of the laser surface alloying treatment.

10 head portion
20 basal body
30 alloyed layer
40 heat affected zone
50 handle
51 combined hole
S screwdriver head

DETAILED DESCRIPTION OF THE PREFERRED EMBODIMENTS

The screwdriver head proposed by the present invention is one part of the screwdriver, which is mainly used for directly contacting a screw head of a screw, to drive the screw to rotate. According to its type, the screwdriver can be categorized into an ordinary integrated screwdriver and a combined screwdriver, both the ordinary screwdriver and the combined screwdriver have handles, in which the handle of the ordinary screwdriver is inseparably integrated with its screwdriver head; the handle of the combined screwdriver can be combined with or separated from its screwdriver head.

Figure 1B:
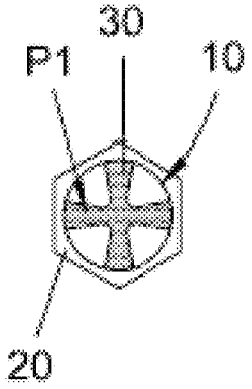
FIG. 1B is a right side view of the embodiment configuration of FIG. 1A.

FIGS. 1A and 1B show one embodiment configuration of the screwdriver head proposed by the present invention, including: a head portion 10 for being inserted into the slot of the screw head, a basal body 20 for supporting the head portion 10, and an alloyed layer 30 formed on the surface of the head portion 10.

The basal body 20 is connectable with the handle to form the screwdriver. The basal body 20 is used for supporting the head portion 10 and transmitting the torque of the handle to the head portion 10 when screwing or unscrewing the screws; the basal body 20 is usually a rod-like member, and is necessary to satisfy the requirement of high tenacity. The shape of the cross section in the radial direction of the basal body 20 is not particularly specified, generally including any one of a circular shape and a polygon (for example, hexagon) shape.

In one embodiment of the screwdriver head proposed by the present invention, the head portion 10 and the basal body 20 are made by a first metal material. In order to meet the requirement of high tenacity, the first metal material is any one of spring steel, alloy structural steel and tool steel, and is selectable from, but not limited to, 50CrV (Chinese brand) spring steel, S2 (American brand) alloyed tool steel, 9SiCr (Chinese brand) alloyed tool steel, 40 Cr (Chinese brand) alloy structural steel, and the like. In one embodiment of the screwdriver head proposed by the present invention, the screwdriver head including the head portion 10 and the basal body 20 is manufactured by the process for manufacturing a conventional screwdriver head, including manufacturing flows of blanking, machining, bulk heat treatment, surface electroplating, and blackening head portion 10.

Figure 5:
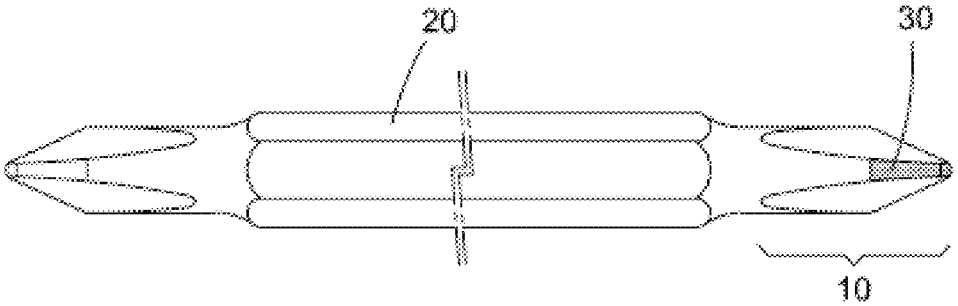
FIG. 5 is a structural diagram of another embodiment of the screwdriver head of the present invention, showing the configuration of the screwdriver head with two head portions.

As shown in FIGS. 1A and 1B, one preferred embodiment configuration of the screwdriver head proposed by the present invention includes at least one head portion 10, the basal body 20 for supporting the head portion, and the alloyed layer 30 formed on the surface of the head portion 10 which is located at one end of the basal body 20. Further, a common person skilled in the art shall understand that the screwdriver head of the present invention can also be a double-headed screwdriver head after learning the preferred embodiment configuration of the above screwdriver head of the present invention. As shown in FIG. 5, another embodiment of the screwdriver head proposed by the present invention includes: two head portions 10, a basal body 20 for supporting the head portion 10 and two alloyed layers 30 respectively formed on the surfaces of the two head portions 10 which are respectively located at two ends of the basal body 20. Such a screwdriver head with two head portions 10 is usually taken as a screwdriver head of the above combined screwdriver. The two head portions can be exchanged by combing the screwdriver and the handle, separating and exchanging them, and then combining them again.

According to the shape of the slot of the screw head, the head portion 10 of the screwdriver head proposed by the present invention for being inserted into the slot of the screw head has any one of a cross shape, a slotted shape, a star shape, an intersected shape, a square shape and a hexagonal shape. In the embodiment of the present invention in which there are two head portions 10, the shapes of the two head portions 10 can be the same or different.

Figure 2A:
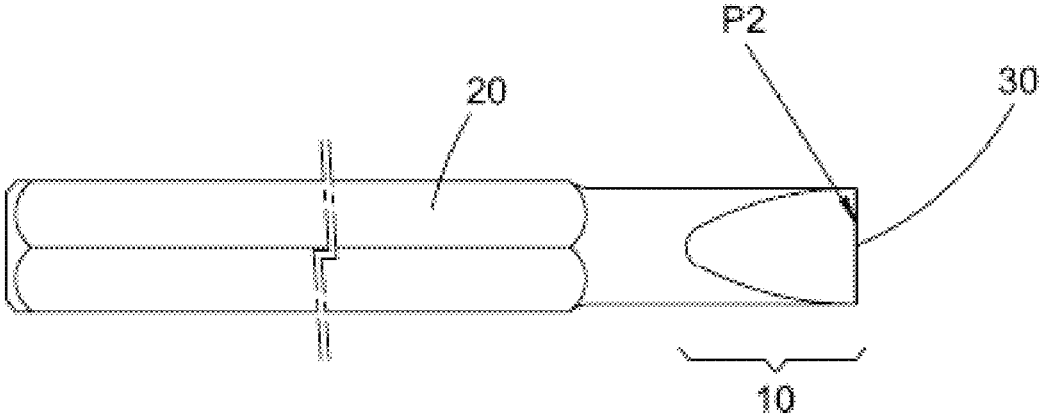
FIG. 2A is a structural diagram of another embodiment of the screwdriver head of the present invention, showing the configuration of the screwdriver head with a slotted head portion and the position of the laser surface alloying treatment.
Figure 2B:
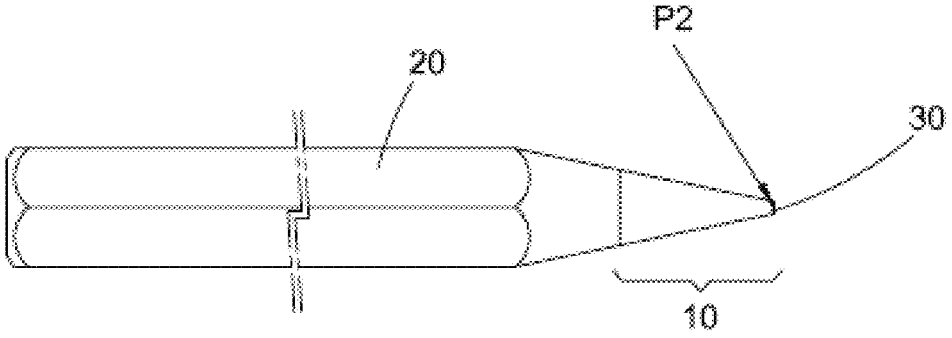
FIG. 2B is a top view of the embodiment configuration of FIG. 2A.
Figure 3A:
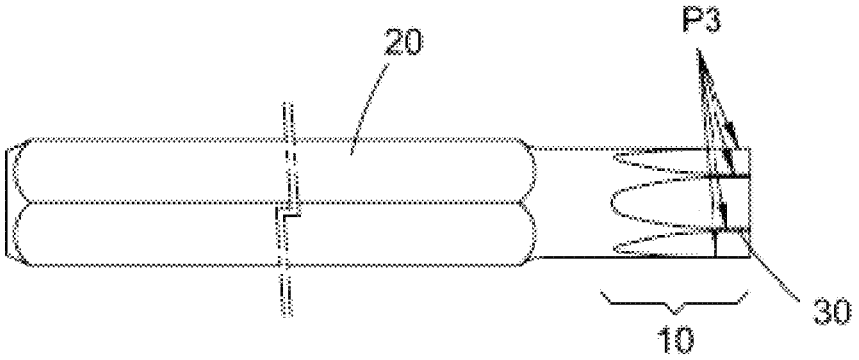
FIG. 3A is a structural diagram of yet another embodiment of the screwdriver head of the present invention, showing the configuration of the screwdriver head with a star-shaped head portion and the position of the laser surface alloying treatment.
Figure 3B:
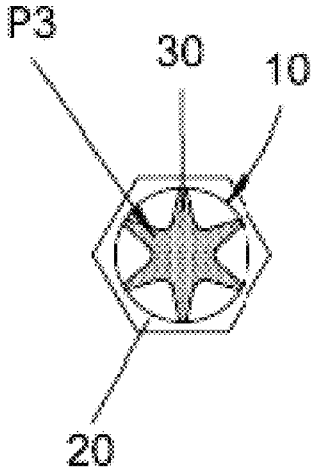
FIG. 3B is a right side view of the embodiment configuration of FIG. 3A.
Figure 4A:
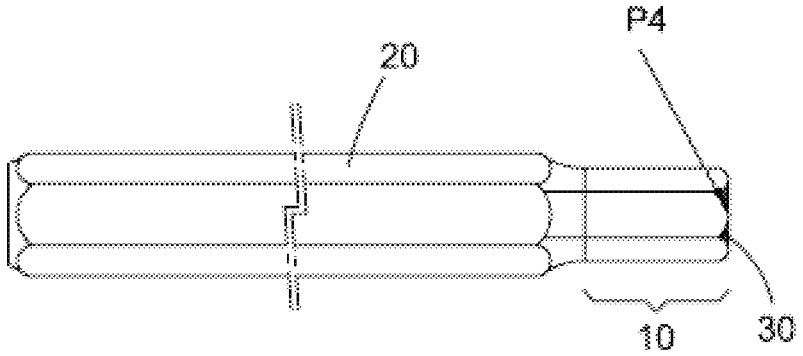
FIG. 4A is a structural diagram of yet another embodiment of the screwdriver head of the present invention, showing the configuration of the screwdriver head with a square head portion and the position of the laser surface alloying treatment.
Figure 4B:
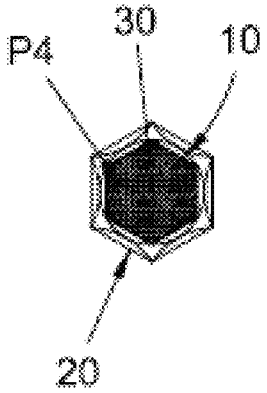
FIG. 4B is a right side view of the embodiment configuration of FIG. 4A.

As a preferred structure of the screwdriver head of the present invention, the alloyed layer 30 is formed to the position at which the head portion 30 contacts with the slot of the screw head. The embodiment shown in FIGS. 1A and 1B describes a screwdriver head with the cross-shaped head portion 10, in which the alloyed layer 30 is formed to the position P1 shown in FIGS. 1A and 1B. The embodiment shown in FIGS. 2A and 2B describes a screwdriver head with the slotted head portion 10, in which the alloyed layer 30 is formed to the position P2 shown in FIGS. 2A and 2B. The embodiment shown in FIGS. 3A and 3B describes a screwdriver head with the star-shaped head portion 10, in which the alloyed layer 30 is formed to the position P3 shown in FIGS. 3A and 3B. The embodiment shown in FIGS. 4A and 4B describes a screwdriver head with the hexagonal head portion 10, in which the alloyed layer 30 is formed to the position P4 shown in FIGS. 4A and 4B.

The alloyed layer 30 is formed by alloying coating coated on the surface of the head portion at least containing one or more alloy elements of C, B, Si, N, O, Al, Mo, V, W and Ti by conducting laser surface alloying treatment; the depth of the alloyed layer 30 (in the normal direction of the surface of the contact position subjected to the laser surface alloying treatment, a distance extending inward from the surface) is no less than 0.05 mm.

Figure 6:
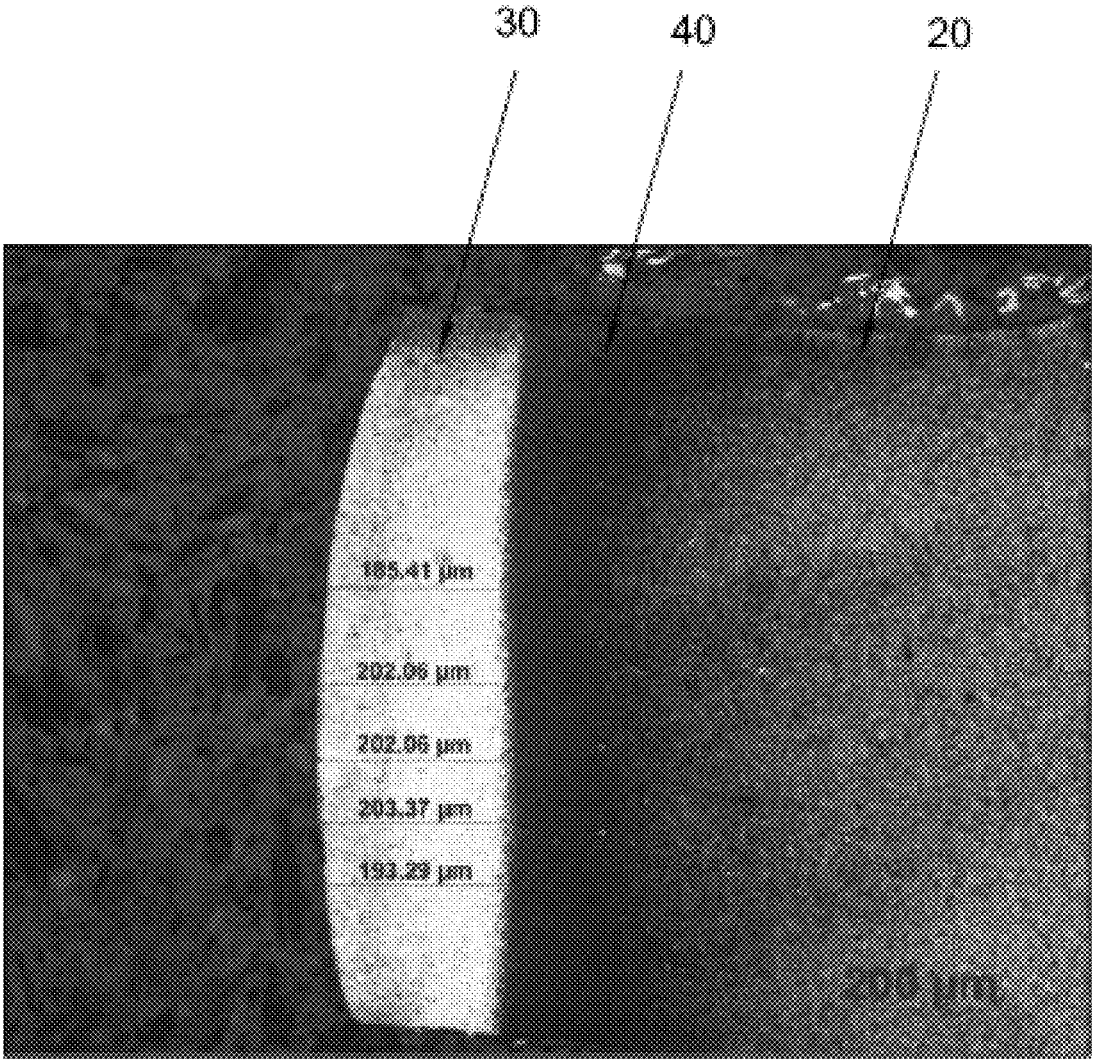
FIG. 6 is a metallography of one embodiment configuration of the screwdriver head of the present invention, showing the alloyed layer, the basal body and a metallographic structure between the alloyed layer and the basal body.

According to the embodiment configuration of the above screwdriver head of the present invention, the first metal material is adopted to produce the screwdriver head with the head portion 10 and the basal body 20 as well as the alloyed layer 30 formed through the laser surface alloying treatment. As shown in FIG. 6, by the observation of the metallographic structure of the alloyed layer 30, the alloyed layer 30 has a cryptocrystalline martensite structure with tiny crystal particle size, the alloyed layer 30 has nearly no defects of segregation, microcrack, air hole and slag inclusion, and compared with the rigidity of the basal body 20, the rigidity of the alloyed layer 30 is increased by greater than 2 HRC. By the observation of the alloyed layer 30, the basal body 20 and the metallographic structure between the alloyed layer 30 and the basal body 20 (shown in FIG. 6), a heat affected zone 40 is formed between the alloyed layer 30 and the basal body 20, and the width of the heat affected zone 40 is no greater than 1.0 mm, and compared with the rigidity of the normal basal body 20, the rigidity of the heat affected zone 40 is decreased, with a decreased magnitude no greater than 8 HRC. Therefore, the alloyed layer 30 is formed at the head portion 10 of the screwdriver head by a surface modification process of the laser surface alloying treatment, which makes the head portion 10 have high rigidity and high abrasive resistance and other positions have high tenacity, thereby enabling the screwdriver head proposed by the present invention to have a relatively longer service life.

Another aspect of the present invention provides a method for manufacturing the above screwdriver head, in one embodiment, comprising:

providing a screwdriver head which is made of a first metal material and includes a basal portion 10 and a head portion 20;

preparing alloying coating;

coating the alloying coating on the surface of the head portion 10 of the screwdriver head;

conducting laser surface alloying treatment on the surface of the head portion 10 coated with the alloying coating, and forming an alloyed layer 30 on the surface of the head portion 10; and conducting low temperature tempering treatment on the screwdriver head after the laser surface alloying treatment.

In one preferred embodiment of the above manufacturing method of the present invention, the alloying coating is coated on the surface of the position at which the head portion 10 of the screwdriver head contacts with the slot of the screw head. In view of different shapes of the head portion 10, the contact position can be referred to FIGS. 1A~4B. The embodiment shown in FIGS. 1A and 1B describes a screwdriver head with the cross-shaped head portion 10, in which the alloyed layer 30 is formed to the position P1 shown in FIGS. 1A and 1B. The embodiment shown in FIGS. 2A and 2B describes a screwdriver head with the slotted head portion 10, in which the alloyed layer 30 is formed to the position P2 shown in FIGS. 2A and 2B. The embodiment shown in FIGS. 3A and 3B describes a screwdriver head with the star-shaped head portion 10, in which the alloyed layer 30 is formed to the position P3 shown in FIGS. 3A and 3B. The embodiment shown in FIGS. 4A and 4B describes a screwdriver head with the hexagonal head portion 10, in which the alloyed layer 30 is formed to the position P4 shown in FIGS. 4A and 4B.

In one embodiment, by mass percentage, the alloying coating contains 5~20 of C, 2~18 of B, 2~38 of Si, 0.2~6 of N, 0.5~15 of O, 0.3~6 of Al, 2~10 of Mo, 2~10 of V, 2~20 of W and 2~20 of Ti (containing alloy powder of the elements). Preferably, by mass percentage, the alloying coating contains 5.5~17 of C, 2.7~16.6 of B, 2.3~29.6 of Si, 0.22~4.9 of N, 0.56~13.7 of O, 0.33~5.6 of Al, 2.7~9.8 of Mo, 2.7~9.8 of V, 2.7~19.8 of W and 2.7~19.8 of Ti.

In one embodiment, the process parameters for the laser surface alloying treatment includes: 200~3000 W of laser power, 0.2~3 mm of spot diameter, 5~80 mm/min of laser scanning speed, and 0.05~1 mm of the thickness of the alloying coating. Preferably, the process parameters for the laser surface alloying treatment includes: 280~2600 W of laser power, 0.2~2.8 mm of spot diameter, 5.5~75 mm/min of laser scanning speed, and 0.07~1 mm of the thickness of the alloying coating.

In one embodiment of the above manufacturing method of the present invention, the wave length of the laser used in the laser surface alloying treatment is no greater than 10.6 um, and the power of the laser is greater than 2000 W. Preferably, the wave length of the laser is no greater than 1.06 um, and the power of the laser is greater than 2000 W.

In one embodiment of the above manufacturing method of the present invention, the low temperature tempering treatment includes heating the screwdriver head after the laser surface alloying treatment to 160 to 180° C., and conducting heat preservation for 1 hour. In a preferred embodiment, the low temperature tempering furnace with gas cycling is adopted to heat the screwdriver head after the laser surface alloying treatment to 180° C., and the heat preservation is conducted for 1 hour.

As a comparison embodiment, the screwdriver head with a specification of PH2/S2 is selected as the sample for the comparison test. The following test is conducted on practical performance before and after the surface alloying is conducted on the head portion 10 by using the steps of the above manufacturing method of the present invention.

Comparison Sample 1

The comparison sample 1 is a PH2/S2 screwdriver rod in which the surface alloying treatment is not conducted on the head portion 10 by using the steps of the above manufacturing method of the present invention. After the comparison sample 1 is used to screw 500 tapping screws with a size of 3.5*50 mm on the pine board, the head portion 10 has a relatively smooth profile by the front observation under a projector, which shows that the surface of the head portion 10 has been abraded. By the side observation, the working portion of a blade with a corner angle of the head portion 10 is obviously abraded.

Comparison Sample 2

The comparison sample 2 is a PH2/S2 screwdriver rod in which the surface alloying is conducted on the head portion 10 by using the steps of the above manufacturing method of the present invention. After the comparison sample 2 is used to screw 500 tapping screws with a size of 3.5*50 mm on the pine board, by the front observation under a projector, the head portion 10 is not obviously abraded, and by the side observation, the blade with a corner angle of the head portion 10 is obvious and is not abraded.

Another aspect of the present invention provides a screwdriver. The embodiment configuration of the screwdriver shown in FIG. 7 includes a screwdriver head S and a handle 50 for connecting the screwdriver head S; in which the screwdriver head S is the one manufactured by the above manufacturing method of the present invention, or the screwdriver head disclosed by the above embodiment configuration of the present invention.

Figure 7:
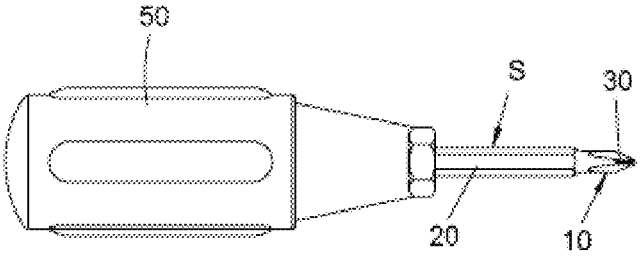
FIG. 7 is a structural diagram of one embodiment of the screwdriver of the present invention.

As one embodiment configuration of the screwdriver of the present invention, as shown in FIG. 7, the handle 50 is inseparably integrated with the screwdriver head S.

Figure 8:
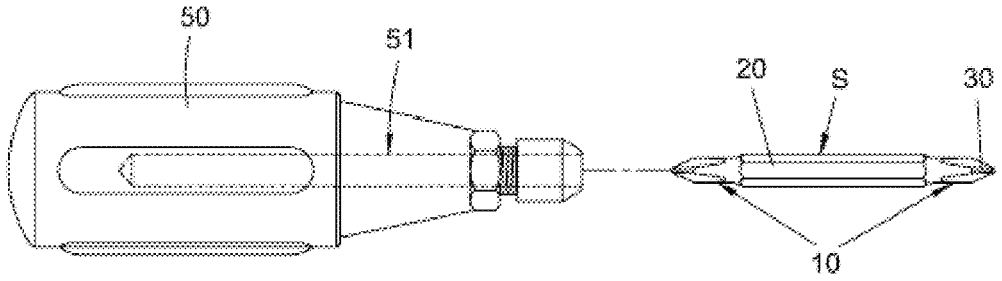
FIG. 8 is a structural diagram of another embodiment of the screwdriver of the present invention.

FIG. 8 shows another embodiment configuration of the screwdriver of the present invention, in which the handle 50 of the screwdriver is provided with a combined hole 51, into or from which the basal body 20 of the screwdriver head S can be inserted or withdrawn. There is provided a combined screwdriver in which the handle 50 can be combined with or separated from the screwdriver head S.

Several specific embodiments of the present invention have been described herein in terms of the above embodiments. It should be understood that a common person skilled in the art can make a multitude of modifications and variations based on the conception of the present invention, after learning the above conception, specific embodiment and effects of the present invention. Therefore, any technical schemes, acquired by the person skilled in the art based on the conception of the present invention through logical analyses, deductions or limited experiments, fall within the scope of the invention as specified in the claims.

The invention claimed is:

1. A method for manufacturing a screwdriver head, comprising:

providing a screwdriver head made of a first metal material, wherein the screwdriver head comprises a head portion for being inserted into a slot of a screw head and a basal body for supporting the head portion;

preparing an alloying coating;

coating the alloying coating on a surface of the head portion of the screwdriver head;

conducting laser surface alloying treatment on the surface of the head portion coated with the alloying coating, and forming an alloyed layer on the surface of the head portion; and conducting low temperature tempering treatment on the screwdriver head after the laser surface alloying treatment;

wherein the alloying coating contains by mass percentage: 5~20 of C, 2~18 of B, 2~38 of Si, 0.2~6 of N, 0.5~15 of O, 0.3~6 of Al, 2~10 of Mo, 2~10 of V, 2~20 of W and 2~20 of Ti; and wherein the low temperature tempering treatment comprises heating the screwdriver head after the laser surface alloying treatment to a temperature in the range between 160° C. and 180° C. and conducting heat preservation for 1 hour.

2. The method for manufacturing a screwdriver head according to claim 1, wherein the alloying coating is coated on the surface of a position at which the head portion of the screwdriver head contacts with the slot of the screw head.

3. The method for manufacturing a screwdriver head according to claim 1, wherein the first metal material is selected from the group consisting of spring steel, alloy structural steel, and tool steel.

4. The method for manufacturing a screwdriver head according to claim 1, wherein by mass percentage, the alloying coating contains 5.5~17 of C, 2.7~16.6 of B, 2.3~29.6 of Si, 0.22~4.9 of N, 0.56~13.7 of O, 0.33~5.6 of Al, 2.7~9.8 of Mo, 2.7~9.8 of V, 2.7~19.8 of W and 2.7~19.8 of Ti.

5. The method for manufacturing a screwdriver head according to claim 1, wherein the process parameters for the laser surface alloying treatment comprises: 200~3000 W of laser power, 0.2~3 mm of spot diameter, 5~80 mm/min of laser scanning speed, and 0.05~1 mm of the thickness of the alloying coating.

6. The method for manufacturing a screwdriver head according to claim 5, wherein the process parameters for the laser surface alloying treatment comprises: 280~2600 W of laser power, 0.2~2.8 mm of spot diameter, 5.5~75 mm/min of laser scanning speed, and 0.07~1 mm of the thickness of the alloying coating.

7. The method for manufacturing a screwdriver head according to claim 1, wherein the wave length of the laser used in the laser surface alloying treatment is no greater than 10.6 um, and the power of the laser is greater than 2000 W.

8. The method for manufacturing a screwdriver head according to claim 1, wherein the wave length of the laser used in the laser surface alloying treatment is no greater than 1.06 um, and the power of the laser is greater than 2000 W.

9. The method for manufacturing a screwdriver head according to claim 1, wherein the low temperature tempering treatment comprises heating the screwdriver head after the laser surface alloying treatment to 180° C. by using a low temperature tempering furnace with gas cycling, and conducting heat preservation for 1 hour.

10. A screwdriver head, comprising:

at least one head portion for being inserted into a slot of a screw head, a basal body for supporting the head portion, and an alloyed layer formed on the surface of the head portion;

the head portion and the basal body are made of a first metal material;

the alloyed layer is formed by alloying coating on the surface of the head portion by conducting laser surface alloying treatment and conducting low temperature tempering treatment on the screwdriver head after the laser surface alloying treatment, wherein the alloying coating contains by mass percentage: 5~20 of C, 2~18 of B, 2~38 of Si, 0.2~6 of N, 0.5~15 of O, 0.3~6 of Al, 2~10 of Mo, 2~10 of V, 2~20 of W and 2~20 of Ti, and wherein the low temperature tempering treatment comprises heating the screwdriver head after the laser surface alloying treatment to a temperature in the range between 160° C. and 180° C. and conducting heat preservation for 1 hour.

11. The screwdriver head according to claim 10, wherein the alloyed layer is formed at a position at which the head portion contacts with the slot of the screw head.

12. The screwdriver head according to claim 10, wherein the depth of the alloyed layer is no less than 0.05 mm.

13. The screwdriver head according to claim 10, wherein a heat affected zone is provided between the alloyed layer and the basal body, and the width of the heat affected zone is no greater than 1.0 mm.

14. The screwdriver head according to claim 13, wherein compared with the rigidity of the basal body, the rigidity of the heat affected zone is decreased, with a decreased magnitude no greater than 8 HRC.

15. A screwdriver, comprising the screwdriver head according to claim 10, and a handle used for connecting the screwdriver head.

16. The screwdriver according to claim 15, wherein the handle is inseparably integrated with the screwdriver head.

17. The screwdriver according to claim 15, wherein the handle is provided with a combined hole, the basal body of the screwdriver head can be inserted into or withdrawn from the combined hole.

* * * * *